United States Patent [19]

Greenberger

[11] 4,373,693

[45] Feb. 15, 1983

[54] SHELF MOLDING CLIP ASSEMBLY

[75] Inventor: William Greenberger, White Plains, N.Y.

[73] Assignee: The Hopp Press, Inc., New York, N.Y.

[21] Appl. No.: 166,537

[22] Filed: Jul. 7, 1980

[51] Int. Cl.[3] ..... E04G 5/06

[52] U.S. Cl. ..... 248/221.4; 248/225.1

[58] Field of Search ..... 248/221.4, 225.1, 220.2, 248/223.4, 222.2, 222.3, 223.3; 40/11 R

[56] References Cited

U.S. PATENT DOCUMENTS

| | | | |
|---|---|---|---|
| 2,612,380 | 9/1952 | Cawl | 248/222.3 X |
| 2,927,701 | 3/1960 | Lynde | 40/11 R X |
| 2,936,539 | 5/1960 | Landis | 40/11 R X |
| 3,081,568 | 3/1963 | Smith | 40/11 R X |
| 3,129,751 | 4/1964 | Weber | 248/222.3 X |
| 3,231,951 | 2/1966 | Armond | 40/11 R X |
| 3,325,929 | 6/1967 | Mauchline | 40/11 R |
| 3,728,806 | 4/1975 | Kostiuk | 40/11 R |
| 3,899,841 | 8/1975 | Berger | 40/11 R |
| 4,016,977 | 4/1977 | Krautsack | 248/221.4 X |
| 4,179,138 | 12/1979 | Bogdanovic | 248/221.4 X |

*Primary Examiner*—J. Franklin Foss

*Attorney, Agent, or Firm*—Kane, Dalsimer, Kane, Sullivan & Kurucz

[57] ABSTRACT

A clip is provided including a pair of arms for holding a sign or the like therebetween. The arms are affixed to a flat, resilient, rectangular member which is capable of being locked within the flanges of a shelf molding. The arms may be attached to the flat member in such a manner that a pair of opposing recesses are provided between them. The clip may then be secured to a resilient planar member having an appropriately shaped hole therein.

9 Claims, 5 Drawing Figures

44
42
43
46
48
45
44
40
24
4
14
22
12
35
18
10
34
20
16
28
26
32
30
38
35
4
37

3
36
43
26
16
45
18
14
20
28
22
42
12
34
10
24
3

36
34
45
35
24
22
16
42
43
35

22
10
16
12
18
16
34
26
30
35
37

26
37
30
32
38
34
18
16
28
24
22
36
14
12
10

SHELF MOLDING CLIP ASSEMBLY

BACKGROUND OF THE INVENTION

The field of the invention relates to devices for attaching display signs to shelf moldings.

In my copending application entitled "Shelf Sign Device", a resilient plastic member is disclosed which snaps into a conventional shelf molding. A portion of the member having an adhesive thereon extends therefrom. The device has proven to be advantageous in a number of commercial applications.

SUMMARY OF THE INVENTION

The present invention is directed to a clip which may be easily secured to a shelf molding. The clip may be directly attached to a molding or secured to a mounting device which is appropriately attached to the molding. The mounting device may resemble that shown in the above-referenced copending application, but includes means for receiving the clip.

The clip includes a pair of gripping arms which define a channel therebetween. A sign positioned between the arms will be held securely due to pressure applied by the arms. The arms are secured to a resilient planar member which can be snapped between the flanges of a shelf molding. The clip may be directly attached to the molding in this manner.

If one wishes to orient the clip differently with respect to the molding, the above-mentioned mounting device is utilized. The mounting device includes a first portion which is snapped within the molding and a second portion which extends outwardly therefrom. The second portion is adapted for receiving the clip. A longitudinal opening therein may serve for retaining the clip in the desired position.

DETAILED DESCRIPTION OF THE INVENTION

Figure 2:
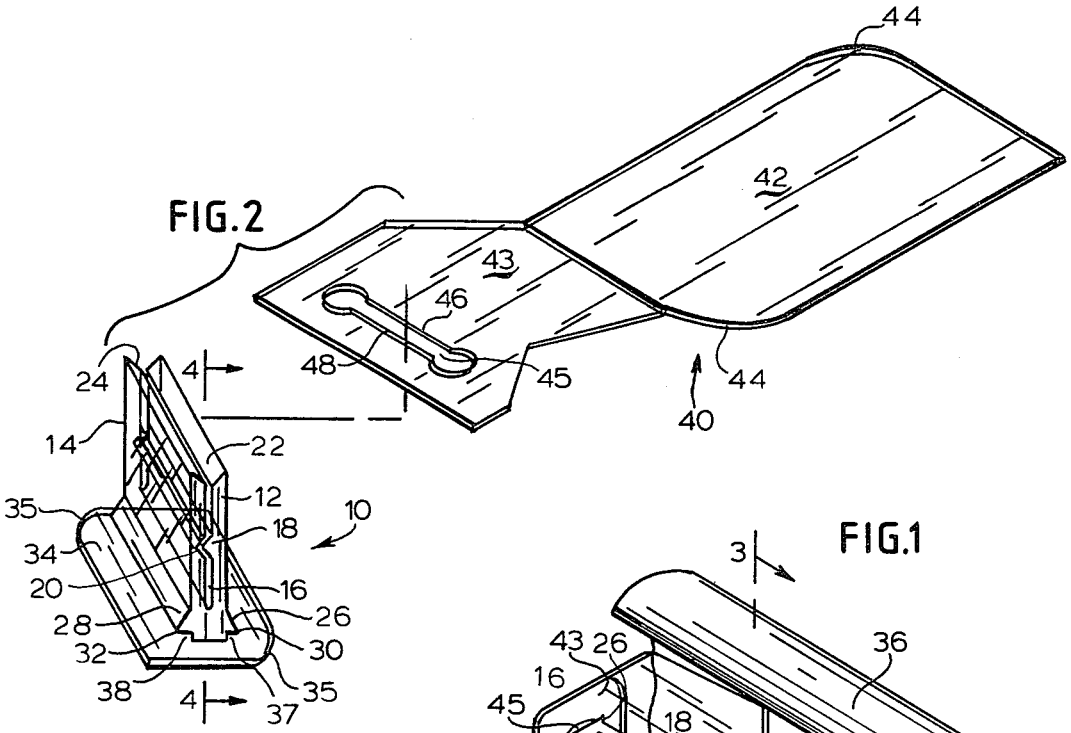
FIG. 2 is an exploded view of an embodiment of the invention prior to assembly.
Figure 1:
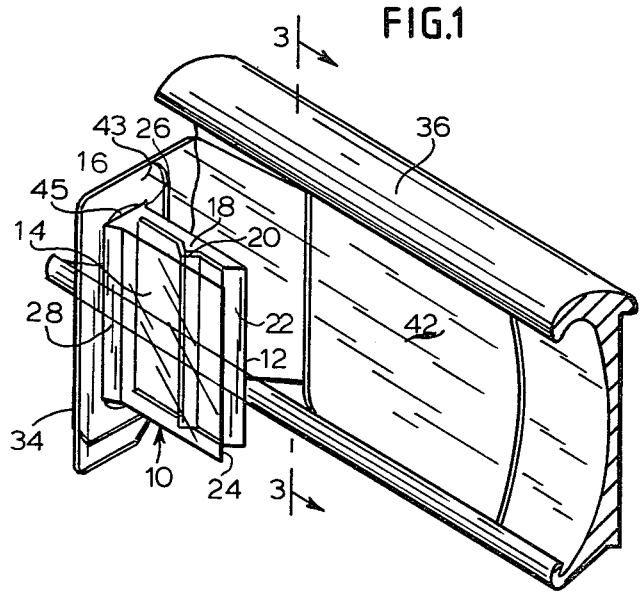
FIG. 1 is a perspective view of one embodiment of the invention as utilized within a shelf molding.
Figure 3:
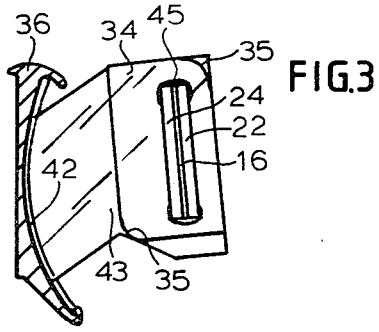
FIG. 3 is a partial sectional view of the invention as applied to a shelf molding.
Figure 4:
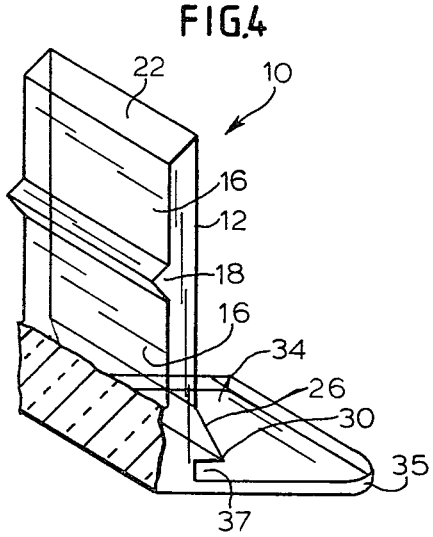
FIG. 4 is a perspective view of one half of a shelf molding clip.

A molding clip 10 is provided which is easily inserted within the channel of a shelf molding. The clip 10 includes a pair of arms 12, 14 defining an irregularly shaped channel 16 therebetween. The arms are connected to one another at the base of the clip and may be integrally molded from plastic. The resiliency of the plastic utilized may vary in accordance with the intended use of the clip. When the arms are forced outwardly due to the insertion of a sign or the like within the channel 16, they will exert pressure thereon. One 12 of the arms includes a V-shaped protruding ridge 18 extending into the channel 16. The other 14 includes a V-shaped recess 20 positioned opposite the ridge 18. Material inserted between the arms will accordingly be deformed slightly while being gripped more securely.

Each of the arms 12, 14 includes a rounded outer edge 22, 24. The rounded edges permit the insertion of material within the channel 16 without difficulty.

The outer surfaces 26, 28 of each of the arms are substantially flat. They are also tapered so that the clip is relatively narrow at the outer edges 22, 24 of the arms and wider at the base. Ridges 26, 28 are provided near the base of the clip. The ridges are somewhat triangular in shape and abruptly terminate near the closed end of the clip. A pair of abutments 30, 32 are accordingly formed.

Figure 5:
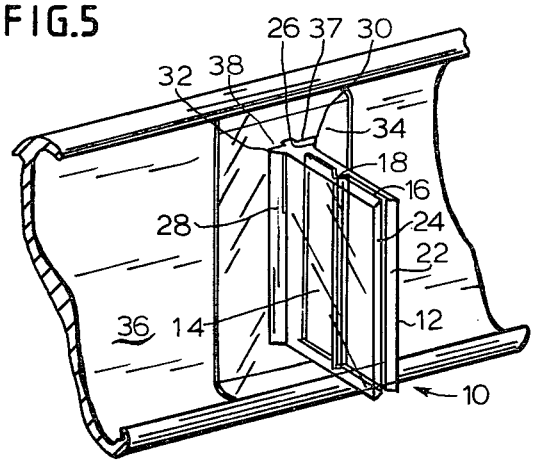
FIG. 5 shows an alternative manner in which the invention may be applied to a shelf molding.

The base of the clip is affixed to a substantially planar square plastic member 34 positioned perpendicularly with respect thereto. The member 34 may have greater resiliency than the clip. At least two diametrically opposed rounded corners 35 are provided thereon to facilitate its attachment to a shelf molding 36. The member 34 is inserted into a molding and then turned in a clockwise direction with the rounded edges contacting the molding. A pair of its parallel edges then engage the flanges of the molding to lock the clip into place. This is shown in FIG. 5.

The plastic member 34 and the abutments 30, 32 form an opposing set of recesses 37, 38 near the base of the clip. They are used in a manner described below.

To mount the clip in an alternative position, a mounting device 40 is provided as shown in FIG. 2. The mounting device includes a first resilient roughly rectangular 42 member which can be snapped within the channel of a shelf molding. A second resilient member 43 is integrally formed with the first member and can be folded with respect thereto. When the first member is snapped within a shelf molding, the second member can extend outwardly from the molding. The planar mounting device may resemble the embodiment shown in my copending application entitled "Shelf Sign Device". It may also include diametrically opposing rounded edges 44 similar to those of member 34.

The second member includes a hole 45 therein which is capable of receiving the clip. The hole has two rounded ends connected by a relatively straight portion. The width of the hole is greater at the end portions than at the middle. A pair of resilient flanges 46, 48 are accordingly formed.

The width and height of the hole 45 are such that the clip may be inserted therein. As the clip is inserted, the flanges 46, 48 flex until they pass over the ridges 26, 28. They then snap behind the ridges and are locked in the opposing recesses 36, 38. By constructing the hole in the manner described, flanges 46, 48 are able to flex without creating undue stress at any one point in the transparent second member 42.

The clip may be fabricated so that it can be mounted to other structures as well. The rear side of the plastic member 34 can be provided with an adhesive for application to flat vertical surfaces. Other modifications are also conceivable.

What is claimed is:

1. A clip adapted for use with a shelf molding comprising:

a substantially planar, resilient mounting member having an appropriate shape for engaging the parallel flanges of a shelf molding said mounting member having a pair of diametrically opposed rounded corners whereby the mounting member may be twisted into engagement with the parallel flanges of the shelf molding;

a pair of resilient, opposing gripping arms substantially perpendicularly affixed to said planar member, said arms having inner surfaces defining a channel therebetween; and, said arms being integrally constructed as one piece and connected to each other near their point of affixation to said planar member, each of said arms having an outer surface including a ridge thereon, said ridges being positioned approximately the same distance from said planar member and running parallel thereto, each of said ridges terminating prior to the point of affixation of the arms to the planar member so as to define a pair of abutments running parallel to said planar member, said planar member and said abutments defining a pair of parallel recesses.

2. A clip as defined in claim 1 wherein the interior surface of one of said arms includes a protruding ridge and the interior surface of the other of said arms includes a recess therein positioned opposite said protruding ridge.

3. A clip as defined in claim 1 wherein the arms have rounded ends defining an opening to said channel.

4. A mounting device for securing a clip or the like to a shelf molding comprising:

a first resilient planar portion having at least one pair of parallel edges capable of engaging the parallel flanges of a shelf molding said resilient planar portion having a pair of diametrically opposed rounded corners whereby it may be twisted into engagement with the parallel flanges in the shelf molding;

a second resilient planar portion attached to said first portion along one edge thereof by means of a flexible hinge and foldable with respect thereto, said second planar portion including a hole therein; and, said hole having opposing ends of relatively large width connected by a middle portion of lesser width, there being an opposing pair of flanges extending into said hole from said second planar portion at the middle portion of said hole.

5. A device as defined in claim 4 wherein said first and second planar portions are integrally formed.

6. A device as defined in claim 4 or 5 further including a clip within said hole, said clip having an outer surface with an opposing set of recesses therein, said flanges being positioned within said recess.

7. A mounting device for securing a clip or the like to a shelf molding, comprising:

a mounting member having a first resilient planar portion and a second resilient planar portion;

said first resilient planar portion having at least a pair of parallel edges capable of engaging the parallel flanges of a shelf molding; and said second resilient planar portion being foldable with respect to the first resilient planar portion and having a hole therein;

said hole having opposing ends of relatively large width connected by a middle portion of lesser width forming a pair of flanges extending into said hole from second planar portion at the middle portion of said hole; and a clip disposed within said hole having a pair of resilient opposing gripping arms substantially perpendicularly affixed to a planar member said arms having inner surfaces defining a channel therebetween and outter surfaces having a pair of recesses therein for engaging the flanges of said hole.

8. A mounting device as recited in claim 7 wherein the first resilient planar portion is provided with at least a pair of diametrically opposed rounded corners whereby it may be twisted into engagement with the parallel flanges on the shelf molding.

9. A mounting device as recited in claim 7 or claim 8 where in the planar member of the clip is provided with at least a pair of diametrically opposed rounded corners whereby it may be twisted into engagement with the parallel flanges of the shelf molding independently of the first resilient planar portion.

* * * * *